US006679007B1

(12) United States Patent
Minchew et al.

(10) Patent No.: US 6,679,007 B1
(45) Date of Patent: Jan. 20, 2004

(54) INFLATABLE PLAY STRUCTURE

(76) Inventors: David Russell Minchew, 2256 Bardwell Dr., Baton Rouge, LA (US) 70808; Amanda Minchew, 2256 Bardwell Dr., Baton Rouge, LA (US) 70808

( * ) Notice: Subject to any disclaimer, the term of this patent is extended or adjusted under 35 U.S.C. 154(b) by 39 days.

(21) Appl. No.: 10/144,262

(22) Filed: May 13, 2002

(51) Int. Cl.[7] ..... E04G 11/04

(52) U.S. Cl. ..... 52/2.11; 446/89; 446/221; 446/224; 52/233; 135/95

(58) Field of Search ..... 52/233, 2.11, DIG. 13; 135/87, 118, 95, 119, 120.2; 446/85, 89, 106, 221, 224

(56) References Cited

U.S. PATENT DOCUMENTS 5,145,440 A * 9/1992 Boris et al. ..... 446/106

5,893,238 A * 4/1999 Peacock et al. ..... 52/2.18

* cited by examiner

*Primary Examiner*—Carl D. Friedman
*Assistant Examiner*—Naoko Slack

(57) ABSTRACT

An inflatable play structure is provided, comprising a plurality of inflatable tubular elements, each tubular element comprising an elongated flexible wall forming an enclosed gas chamber with a self-sealing nozzle and a plurality of external attachments, a plurality of wall brackets comprising base members and upwardly extending poles, a roof bracket comprising a peak member connected to two base members by poles, and a tent-shaped roof element. The inflatable play structure is ideal for educational play, in particular educational play regarding piece-by-piece construction similar to the building of a conventional log cabin or house.

14 Claims, 3 Drawing Sheets

INFLATABLE PLAY STRUCTURE

BACKGROUND OF THE INVENTION

1. Field of the Invention

The present invention relates to an inflatable play structure for use in connection with educational play. The inflatable play structure has particular utility in connection with educational play regarding piece-by-piece construction similar to the building of a conventional log cabin or house.

2. Description of the Prior Art

Inflatable play structures are desirable for amusement and educational play.

The use of inflatable play structures is known in the prior art. For example, U.S. Pat. No. 5,603,185 to Murphy discloses an inflatable enclosure for amusement purposes. However, the Murphy '185 patent does not provide for different configurations of enclosures to be built, and has the further drawback of not providing for educational play regarding piece by piece construction similar to the building of a conventional log cabin or house.

Similarly, U.S. Pat. No. 5,471,797 to Murphy discloses an inflatable enclosure for amusement purposes. However, the Murphy '797 patent does not provide for different configurations of enclosures to be built, and has the further drawback of not providing for educational play regarding piece by piece construction similar to the building of a conventional log cabin or house.

U.S. Pat. No. 5,678,357 to Rubio et al. discloses an interactive inflatable toy. However, the Rubio '357 patent does not provide for different configurations of inflatable toys to be built, and additionally does not provide for educational play regarding piece by piece construction similar to the building of a conventional log cabin or house.

Similarly, U.S. Des. Pat. No. 389,217 to Rubio et al. discloses an interactive inflatable toy. However, the Rubio '217 patent does not provide for different configurations of inflatable toys to be built, and additionally does not provide for educational regarding piece by piece construction similar to the building of a conventional log cabin or house.

U.S. Pat. No. 3,626,634 to Jones et al. discloses a construction set that allows modular piece by piece construction. However, the Jones '634 patent requires all pieces to be connected at their ends, and therefore can not provide for the construction of a variety of configurations of play structures with windows, doors, or roofs.

Lastly, U.S. Pat. No. 6,008,938 to Suehle et al. discloses an inflatable portable projection screen. However, the Suehle '938 patent does not provide for different configurations of inflatable structures to be built, and is not directed toward educational play.

While the above-described devices fulfill their respective, particular objectives and requirements, the aforementioned patents do not describe an inflatable play structure that allows educational play regarding piece-by-piece construction similar to the building of a conventional log cabin or house. The Jones '634 patent makes no provision for play structures with windows, doors, or roofs.

Therefore, a need exists for a new and improved inflatable play structure that can be used for educational play regarding piece-by-piece construction similar to the building of a conventional log cabin or house. In this regard, the present invention substantially fulfills this need. In this respect, the inflatable play structure according to the present invention substantially departs from the conventional concepts and designs of the prior art, and in doing so provides an apparatus primarily developed for the purpose of educational play regarding piece by piece construction similar to the building of a conventional log cabin or house.

SUMMARY OF THE INVENTION

In view of the foregoing disadvantages inherent in the known types of inflatable play structures now present in the prior art, the present invention provides an improved inflatable play structure, and overcomes the above-mentioned disadvantages and drawbacks of the prior art. As such, the general purpose of the present invention, which will be described subsequently in greater detail, is to provide a new and improved inflatable play structure and method which has all the advantages of the prior art mentioned heretofore and many novel features that result in an inflatable play structure which is not anticipated, rendered obvious, suggested, or even implied by the prior art, either alone or in any combination thereof.

To attain this, the present invention essentially comprises an inflatable play structure comprising a plurality of inflatable tubular elements, a plurality of wall brackets, a roof bracket, and a tent-shaped roof element.

In a preferred embodiment, the present invention comprises an inflatable play structure comprising a plurality of inflatable tubular elements, each tubular element comprising an elongated flexible wall forming an enclosed gas chamber with a self sealing nozzle and a plurality of external attachments, a plurality of wall brackets, each wall bracket comprising a base member and an upwardly extending pole, a roof bracket comprising a peak member connected to two base members by poles, and a tent-shaped roof element.

In another embodiment, the present invention comprises the use of a child's toy for forming buildings and the like comprising a series of brackets having a base member and an upwardly extending pole for the stacking of inflatable tubes held together by attachments formed by hook and loop fasteners positioned about the tube members, such that walls are formed by the system of tubes and brackets, and further comprising a specialized bracket for forming a roof structure or the like, covered by a tent-shaped fabric or plastic tarp.

There has thus been outlined, rather broadly, the more important features of the invention in order that the detailed description thereof that follows may be better understood and in order that the present contribution to the art may be better appreciated.

The invention may also include flat or pitched roofs, awnings, inflatable furniture, and multiple windows and doorways. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved inflatable play structure that has all of the advantages of the prior art inflatable play structures and none of the disadvantages.

It is another object of the present invention to provide a new and improved inflatable play structure that may be easily and efficiently manufactured and marketed.

An even further object of the present invention is to provide a new and improved inflatable play structure that has a low cost of manufacture with regard to both materials and labor, and which accordingly is then susceptible of low prices of sale to the consuming public, thereby making such inflatable play structure economically available to the buying public.

Still another object of the present invention is to provide a new inflatable play structure that provides in the apparatuses and methods of the prior art some of the advantages thereof, while simultaneously overcoming some of the disadvantages normally associated therewith.

Even still another object of the present invention is to provide an inflatable play structure for amusement and educational play. This allows the development of creativity and coordination during play activities.

Still yet another object of the present invention is to provide an inflatable play structure for educational play regarding piece by piece construction similar to the building of a conventional log cabin or house. This makes it possible to learn construction techniques and to build a wide variety of different structures during play.

Lastly, it is an object of the present invention to provide a new and improved method of educational play using an inflatable play structure comprising a plurality of inflatable tubular elements, a plurality of wall brackets, a roof bracket, and a tent-shaped roof element.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
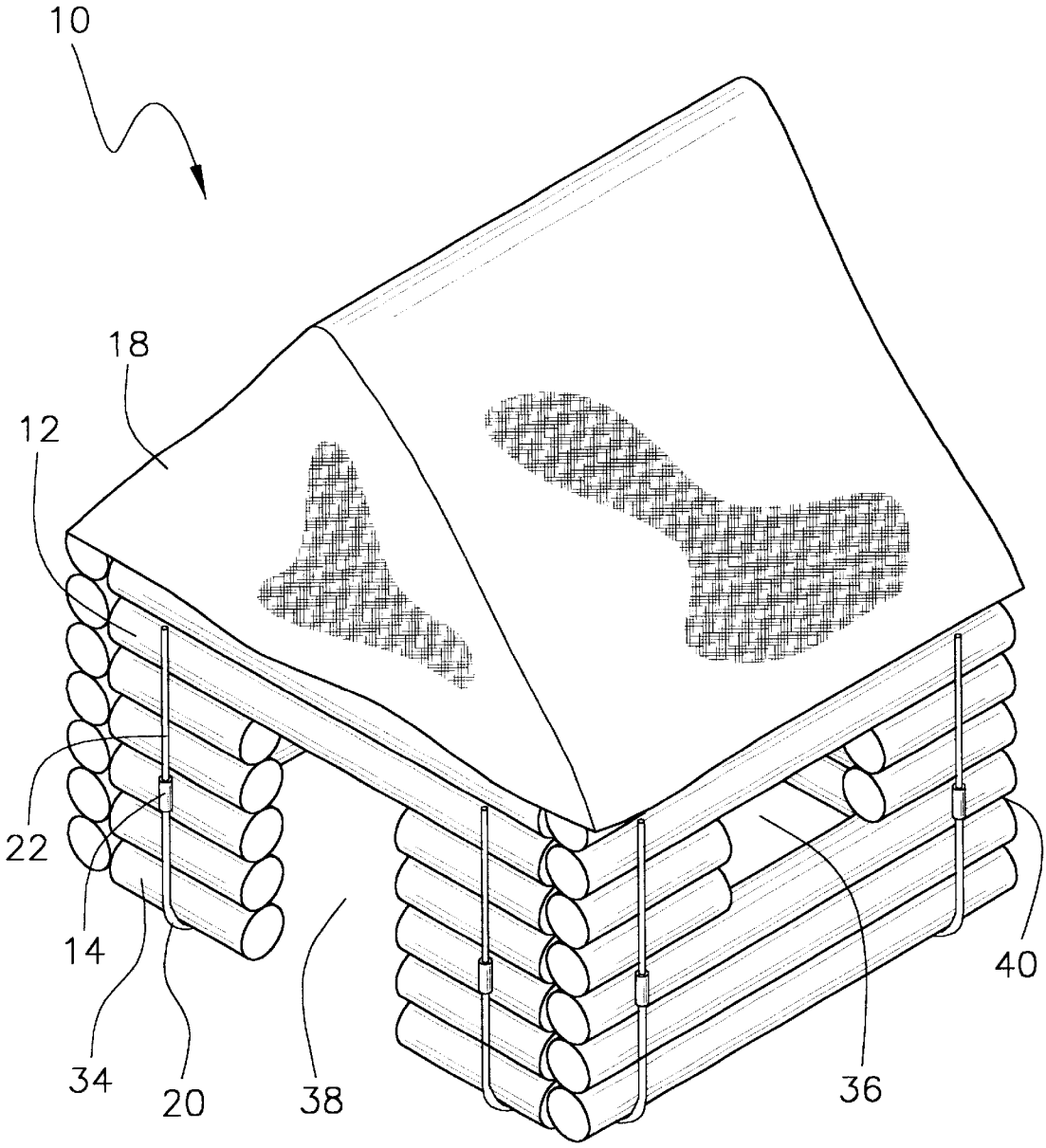
FIG. 1 is a front perspective view from above the preferred embodiment of the inflatable play structure constructed in accordance with the principles of the present invention.

Referring now to the drawings, and particularly to FIGS. 1–4, a preferred embodiment of the inflatable play structure of the present invention is shown and generally designated by the reference numeral 10.

In FIG. 1, a new and improved inflatable play structure 10 of the present invention for educational play, in particular educational play regarding piece by piece construction similar to the building of a conventional log cabin or house, is illustrated and will be described. More particularly, the inflatable play structure 10 has inflatable tubular elements 12 stacked in wall brackets 14, and a roof bracket hidden in this figure by a roof element 18. The wall brackets 14 comprise a wall bracket base member 20 configured to fit the shape of the inflatable tubular elements 12, and a wall bracket adjustable pole 22 fitting into the wall bracket base member 20. The height of the wall brackets 14 may be adjusted by the wall bracket adjustable poles 22 for different heights of inflatable play structures 10. The inflatable tubular elements 12 may be many different sizes, and in this figure are shown to be as long as the full length of an assembled wall 40 or much shorter, illustrated as a small tubular element 34 for placement next to a window 36 or doorway 38. Small tubular elements 34 are shown in this figure next to a window 36, next to a doorway 38, and as part of an assembled wall 40 containing a window 36.

Figure 2:
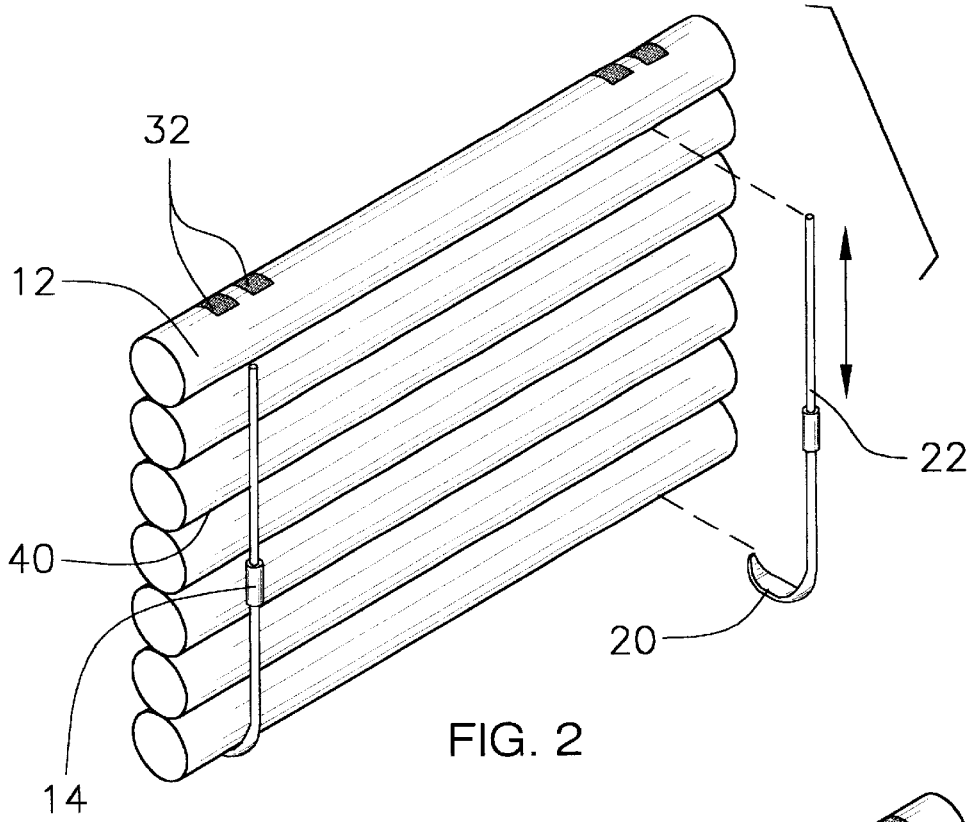
FIG. 2 is a front perspective view of an assembled wall of the inflatable play structure of the present invention.

FIG. 2 is a front perspective view of an assembled wall 40 of the inflatable play structure 10 of the present invention, illustrating inflatable tubular elements 12, and wall brackets 14 comprising wall bracket base members 20 and wall bracket adjustable poles 22. The inflatable tubular elements 12 are stacked together in the wall brackets 14 and held together by external attachments 32 to form an assembled wall 40.

Figure 3:
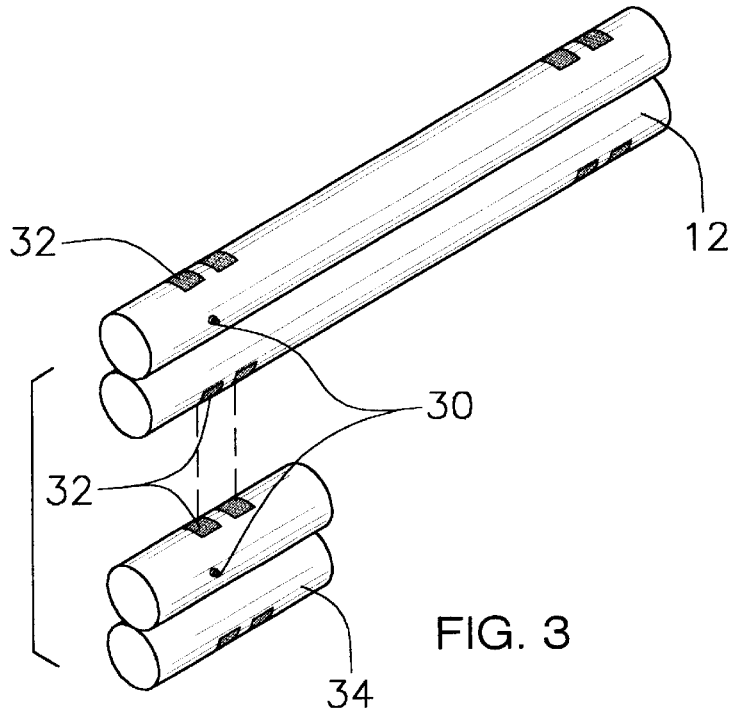
FIG. 3 is a front perspective partial exploded view of a window-containing or doorway-containing wall of the inflatable play structure of the present invention.

FIG. 3 is a front perspective partial exploded view of a window-containing or doorway-containing wall of the inflatable play structure 10 of the present invention, illustrating inflatable tubular elements 12 and small tubular elements 34 held together by external attachments 32. Also illustrated are nozzles 30 for inflation and deflation of the tubular elements 12 and small tubular elements 34.

Figure 4:
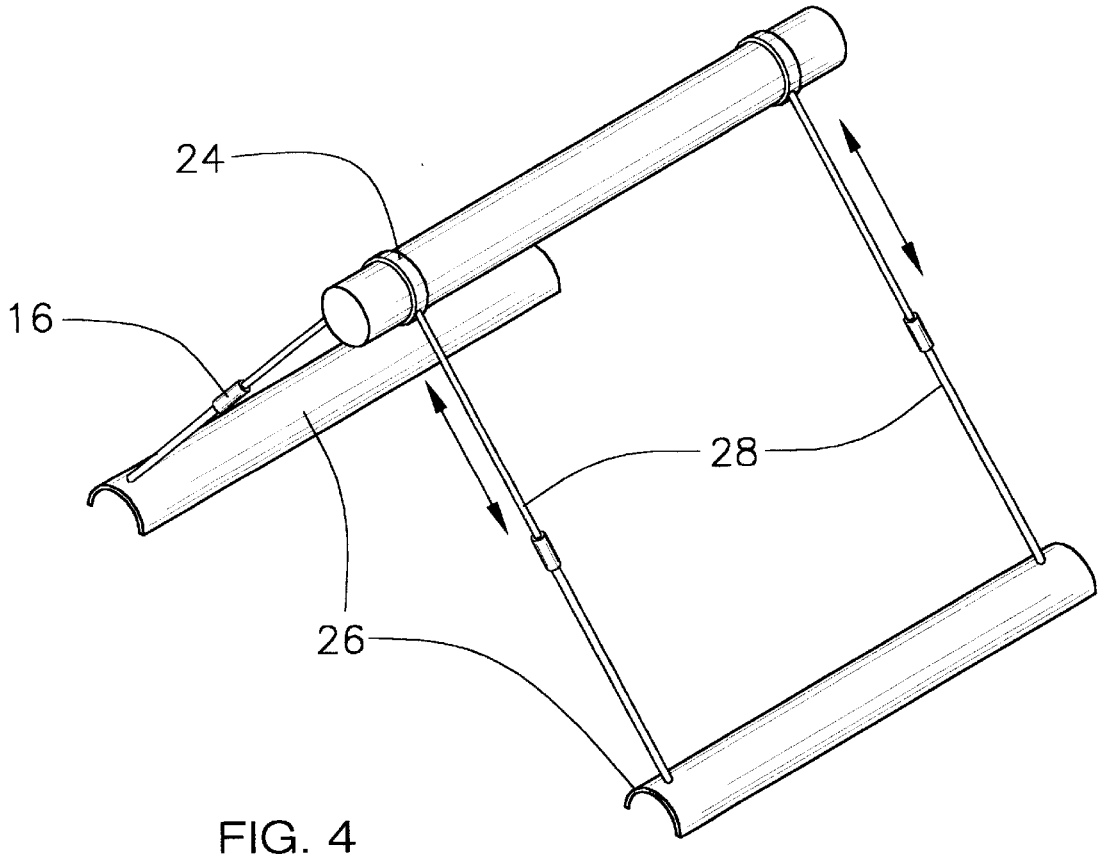
FIG. 4 is a front perspective view of the roof bracket of the inflatable play structure of the present invention.

FIG. 4 is a front perspective view of the roof bracket 16 of the inflatable play structure 10 of the present invention, illustrating the roof bracket peak member 24 and two roof bracket base members 26 connected by roof bracket adjustable poles 28.

The new and improved inflatable play structure of the present invention is ideal for educational play, in particular educational play regarding piece-by-piece construction similar to the building of a conventional log cabin or house. The inflatable play structure is fun for users of all ages, and is especially suitable for children from about the age of 5 to about the age of 13. The inflatable play structure of the present invention is primarily constructed using inflatable tubular elements and brackets. In one embodiment, the inflatable tubular elements comprise an elongated flexible wall forming an enclosed gas chamber, a self-sealing nozzle, and a plurality of external attachments. In a preferred embodiment, the tubular elements are shaped like logs. When deflated, the inflatable play structure of the present invention takes up very little space, and can be easily and conveniently stored and transported in a small box or other suitable container.

The tubular elements may be inflated by blowing into self-sealing nozzles or inflated through the nozzles by using any type of air pump. The nozzles preferably self-seal after inflation so that the tubular elements remain inflated unless a user deliberately squeezes the nozzles to allow air to be removed. The new and improved inflatable play structure of the present invention stimulates creativity because numerous different play structures may be constructed by stacking the inflatable tubular elements to different heights and in different ways. The use of tubular elements of different sizes allows the construction of play structures with windows and doorways. In one embodiment, the tubular elements are shaped like logs and are used to build a log cabin or fort for amusement and educational play purposes.

The inflatable play structure of the present invention is suitable for indoor or outdoor use, is constructed of flexible plastic, and may be clear and transparent or it may also be any color or decorated with any pattern or decoration. In one embodiment, the inflatable play structure of the present invention is constructed of flexible poly(vinyl chloride) (PVC) plastic, and is similar in construction and manufacturability to inflatable rafts which are well-known in the prior art. The flexible plastic preferably contains an ultraviolet absorber material and other suitable stabilizers and antioxidants for resistance to sunlight and resistance to weathering for outdoor use.

The wall brackets of the inflatable play structure of the present invention comprise base members shaped to hold the tubular elements, and adjustable poles to hold stacks of tubular elements of many possible heights. Tubular elements are stacked in the wall brackets and held together by external attachments. In a preferred embodiment, the external attachments are hook and loop fasteners such as Velcro™. The external attachments may also be any other type of suitable attachments such as removable pressure-sensitive adhesive, plastic latches, and the like. The wall brackets may be constructed of metal such as aluminum, or of any suitable rigid plastic such as rigid poly(vinyl chloride) (PVC), polypropylene (PP), a polyethylene (PE) such as high density polyethylene (HDPE), an acrylonitrile-butadiene-styrene (ABS) resin, a styrene-acrylonitrile (SAN) resin, polycarbonate, a polyamide, a polyester such as polyethylene terephthalate (PET) or polybutylene terephthalate (PBT), or blends thereof, as well as any other suitable plastic material known to those skilled in the art. The rigid plastic preferably contains an ultraviolet absorber material and other suitable stabilizers and antioxidants for resistance to sunlight and resistance to weathering for outdoor use.

The roof bracket of the inflatable play structure of the present invention comprises a peak member and two base members connected by adjustable poles to allow the construction of roofs of different sizes. The roof bracket may be constructed of metal such as aluminum, or of any suitable rigid plastic such as rigid poly(vinyl chloride) (PVC), polypropylene (PP), a polyethylene (PE) such as high density polyethylene (HDPE), an acrylonitrile-butadiene-styrene (ABS) resin, a styrene-acrylonitrile (SAN) resin, polycarbonate, a polyamide, a polyester such as polyethylene terephthalate (PET) or polybutylene terephthalate (PBT), or blends thereof, as well as any other suitable plastic material known to those skilled in the art. The roof bracket is covered by a roof element that may be a tarp, a cloth, or a plastic sheet material. The roof element is preferably a tent-shaped flexible fabric or tarp constructed of water-repellant material such as rubber-coated fabric, flexible plastic, or any other suitable tent material known to those skilled in the art. The flexible roof element preferably contains an ultraviolet absorber material and other suitable stabilizers and antioxidants for resistance to sunlight and resistance to weathering for outdoor use. The flexible roof element preferably will not support the weight of a child, so it will not be possible for a child to climb onto it to an unsafe height.

In use, it can now be understood that the inflatable play structure of the present invention is especially suitable for educational play, and in particular educational play regarding piece-by-piece construction similar to the building of a conventional log cabin or house.

While a preferred embodiment of the inflatable play structure has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as wood or composite materials may be used for the brackets instead of the metal or rigid plastic described. Also, different decorations and colors may be used for the inflatable play structure to simulate the appearance of a log cabin, boat, vehicle, recreational vehicle, fort, castle, or any other desirable structure. And although use of the inflatable play structure of the present invention for educational play has been described, it should be appreciated that the inflatable play structure herein described is also suitable for many other possible uses such as a temporary shelter from sunlight or rain. Furthermore, a wide variety of structures and configurations may be used instead of the preferred embodiments described, including structures with flat or pitched roofs, awnings, inflatable furniture, and multiple windows and doorways.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An inflatable play structure comprising:

a plurality of inflatable tubular elements;

a plurality of wall brackets wherein each wall bracket comprises a base member and an upwardly extending pole;

a roof bracket; and a tent-shaped roof element.

2. The inflatable play structure of claim 1, wherein the height of each wall bracket is adjustable.

3. The inflatable play structure of claim 1, wherein the roof bracket comprises a peak member connected to two base members by poles.

4. The inflatable play structure of claim 1, wherein the size of the roof bracket is adjustable.

5. The inflatable play structure of claim 1, wherein the inflatable tubular elements are log shaped.

6. The inflatable play structure of claim 1, wherein each inflatable tubular element comprises:

an elongated flexible wall forming an enclosed gas chamber;

a self sealing nozzle; and a plurality of external attachments.

7. The inflatable play structure of claim 6, wherein the external attachments allow the inflatable tubular elements to be stacked.

8. The inflatable play structure of claim 6, wherein the external attachments are hook and loop fasteners.

9. The inflatable play structure of claim 6, wherein the self sealing nozzle allows air in and out of the inflatable tubular element for inflation and deflation.

10. An inflatable play structure comprising:

a plurality of inflatable tubular elements, each tubular element comprising:

an elongated flexible wall forming an enclosed gas chamber;

a self sealing nozzle; and a plurality of external attachments;

a plurality of wall brackets, each wall bracket comprising a base member and an upwardly extending pole;

a roof bracket comprising a peak member connected to two base members by poles; and a tent-shaped roof element.

11. The inflatable play structure of claim 10, wherein the height of each wall bracket is adjustable.

12. The inflatable play structure of claim 10, wherein the size of the roof bracket is adjustable.

13. The inflatable play structure of claim 10, wherein the inflatable tubular elements are log shaped.

14. The inflatable play structure of claim 10, wherein the inflatable tubular elements comprise flexible poly(vinyl chloride) (PVC) plastic.

* * * * *